US007131489B2

(12) United States Patent
Göhna

(10) Patent No.: US 7,131,489 B2
(45) Date of Patent: Nov. 7, 2006

(54) HEAT EXCHANGER

(75) Inventor: Hermann Göhna, Bad Soden (DE)

(73) Assignee: Lurgi AG, Frankfurt am Main (DE)

( * ) Notice: Subject to any disclaimer, the term of this patent is extended or adjusted under 35 U.S.C. 154(b) by 0 days.

(21) Appl. No.: 10/431,887

(22) Filed: May 8, 2003

(65) Prior Publication Data

US 2003/0226654 A1 Dec. 11, 2003

(30) Foreign Application Priority Data

May 29, 2002 (DE) ..... 102 23 788

(51) Int. Cl.
*F28D 7/10* (2006.01)

(52) U.S. Cl. ..... 165/161; 165/81; 165/82; 165/160

(58) Field of Classification Search ..... 165/159–161, 165/81, 82, 13, 135
See application file for complete search history.

(56) References Cited

FOREIGN PATENT DOCUMENTS

| | | | |
|---|---|---|---|
| DE | 2819777 A1 | * | 11/1978 |
| DE | 30 39 787 A1 | | 4/1981 |
| DE | 34 21 746 A1 | | 12/1985 |
| DE | 36 43 303 A1 | | 6/1988 |
| GB | 1154809 | | 6/1969 |
| JP | 56-77690 A | * | 6/1981 |
| JP | 60-294294 A | * | 10/1985 |
| SU | 494587 | * | 2/1976 |
| SU | 423371 | * | 3/1981 |

OTHER PUBLICATIONS

Abstract of DE 36 43 303 A1 from EPO website database.
Abstract of DE 34 21 746 A1 from EPO website database.

* cited by examiner

*Primary Examiner*—Allen J. Flanigan
(74) *Attorney, Agent, or Firm*—Norris McLaughlin & Marcus PA

(57) ABSTRACT

To create a heat exchanger which provides for a high temperature compensation between the media, can at the same time be produced at low cost and satisfies the thermal stresses, it is proposed that the heat exchanger has a first distribution chamber (5) which is connected with a second distribution chamber (7) by means of tubes (22, 6) for the passage of hot medium (2), the tubes (6) extending through the inlet region (11) of the cooling medium (3) and an outer chamber (12), that lateral ports (9) introduce the cooling medium (3) into an inlet region (10) which is adjoined by an inner chamber (11) defined by a sealing plate (16) for flow deflection of the cooling medium (3), that the sealing plate (16) guides the cooling medium (3) from the inner chamber (11) into the outer chamber (12), the outer chamber (12) enclosing the inner chamber (11), and this outer chamber (11) is provided with ports (18) for discharging the cooling medium (3).

15 Claims, 1 Drawing Sheet

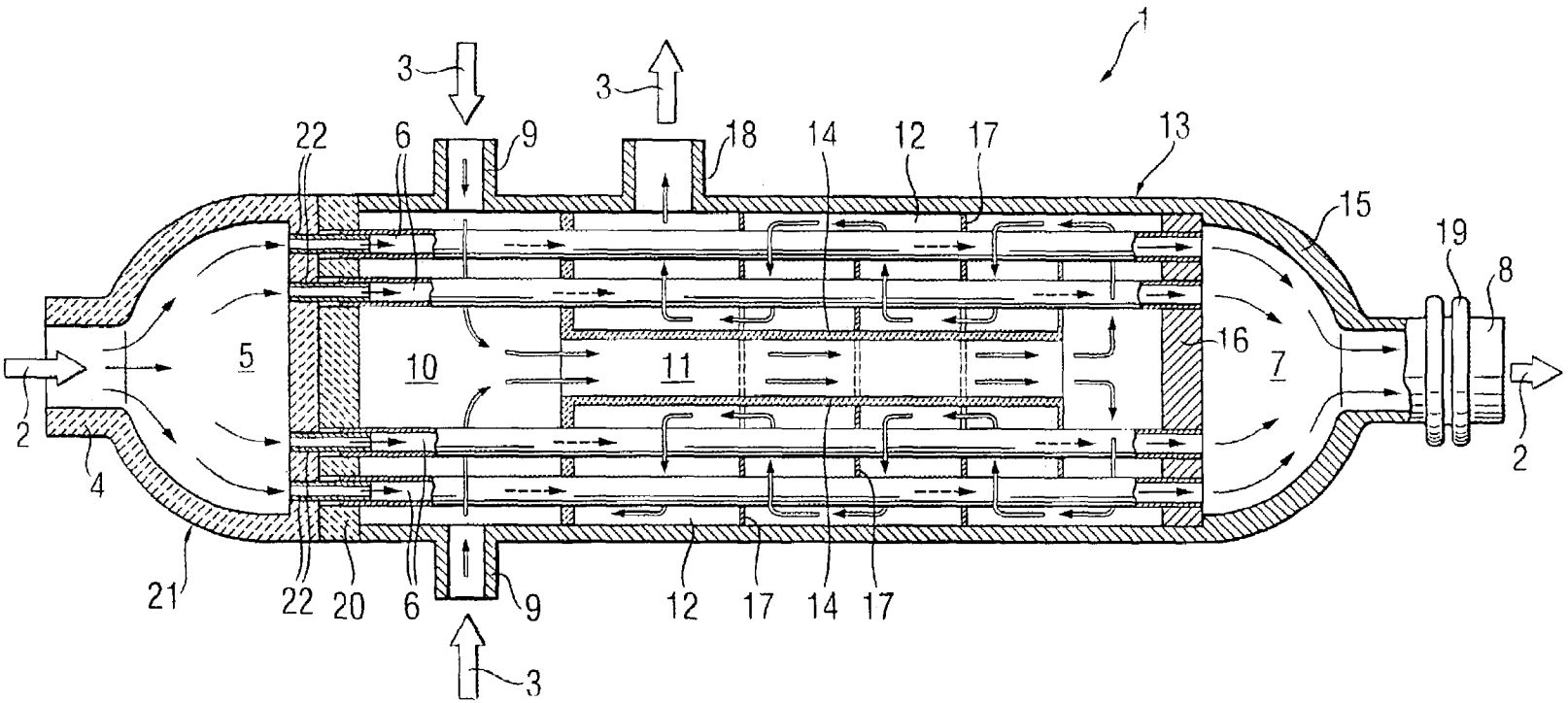
1
2
8
19
15
7
16
13
17
12
14
18
11
3
9
10
6
22
20
5
21
4

HEAT EXCHANGER

DESCRIPTION

This invention relates to a heat exchanger with a cylindrical steel jacket and two hemispherical head pieces, in which hot medium flows through the heat exchanger along the longitudinal axis and is cooled by a cooling medium, which is laterally introduced into and discharged from the heat exchanger.

In processing plants, heat exchangers are used for the recovery of heat or for the selective cooling or heating of a medium which may be gaseous or liquid. A shell-and-tube heat exchanger is for instance used for cooling hot product gases from a partial oxidation. These product gases must be cooled from 520° C. to 350° C., and at the same time gaseous process feed mixture (or in other cases steam) must be preheated from about 200° C. to 420° C. These product gases have a high potential for "metal dusting", a process which leads to the destruction of the metallic materials when the metal temperatures on the product gas side become too high. Metal dusting is understood to be a high-temperature corrosion, which usually occurs in greatly carburizing gas atmospheres and leads to the removal and hence destruction of the metallic material. As removal products there are typically found metal, metal oxide, carbon and metal carbides. If the heat exchanger described would be operated in a countercurrent apparatus, the heat exchanger tubes as well as the tube plates on the hot side would come within the temperature range of the metal dusting. A parallel-flow heat exchanger cannot reach the required preheating temperature because of an overlap.

DE-A-3039787 describes a heat exchanger in which hot medium is laterally introduced into the heat exchanger and upon various types of deflection in the vicinity of the cooling tubes is withdrawn again at the head of the heat exchanger. The cold medium is introduced at the bottom of the heat exchanger and flows through double-walled cooling tubes, the cold medium first being passed through the inner tube up to the end of the tube, in order to then be recirculated in opposite flow direction through the outer tube. There occurs a cooling of the hot medium in a countercurrent process. The temperature compensation possible with this heat exchanger is not sufficient, so that several heat exchangers are necessary.

Proceeding from this prior art it is the object underlying the invention to develop a heat exchanger which provides for a high temperature compensation between the media, can at the same time be produced at low cost and satisfies the thermal and chemical stresses and has a high resistance to high-temperature corrosion.

In accordance with the invention, this object is solved in that the heat exchanger consists of a cylindrical steel jacket and two hemispherical head pieces, a first distribution chamber being connected with a second distribution chamber by means of tubes for the passage of hot medium, the tubes extending through the inlet region of the cooling medium and an outer chamber, and that lateral ports introduce the cooling medium into an inlet region which is adjoined by an inner chamber defined by a sealing plate for flow deflection of the cooling medium, that the sealing plate guides the cooling medium from the inner chamber into an outer chamber, the outer chamber enclosing the inner chamber, and this outer chamber is provided with ports for discharging the cooling medium.

With this arrangement it is achieved that in the inlet region the cooling medium cocurrently flows around the tubes with the hot medium and upon deflection from the inner chamber into the outer chamber countercurrently cools the tubes. Due to this flow a very large heat transfer is possible, whereby the dimensions of the heat exchanger can be kept small. At the same time, the risk of metal dusting is reduced, as the components susceptible to corrosion are decreased in temperature. The risk of metal dusting is increasing with increasing temperature of the components. Due to the inventive design of the heat exchanger the service life is increased distinctly due to the large heat transfer, as the components susceptible to corrosion have a much longer useful life.

The insulation of the dividing wall between inner chamber and outer chamber has the effect that the cooling medium suffers no cooling on the hot side.

Due to the alternating arrangement of the sheets in the outer chamber, the flow is alternately guided past the outer steel jacket of the heat exchanger and past the wall between inner chamber and outer chamber. This also provides for a larger heat transfer.

At the bottom of the distribution chamber, the tubes are welded in. To protect these welding seams against thermal stresses when using gases with a high temperature, the inlet region is thermally separated from the distribution chamber or insulated by a heat-insulating mass. Through this heat-insulating mass, spigots are inserted in the bottom of the distribution chamber, which spigots receive the cooling tubes.

Another aspect of the invention provides that the heat-insulating mass is catalytically active. Leakage flows through cracks in the lining are continuously catalytically converted during the continuous cooling, whereby no metal dusting reaction can occur.

To reduce the thermal stresses of the heat exchanger, the inner parts of the heat exchanger are fabricated in a floating head design. This means that components exposed to a great thermal expansion are firmly mounted on one side only. The other side is freely movable in longitudinal direction.

To compensate the thermal stresses of the steel jacket, the outlet port of the hot medium is equipped with a compensator.

The hot media introduced may be gases or liquids. They are introduced into the heat exchanger with a temperature of 150° C. to 550° C. and are discharged with a temperature in the range from 400° C. to 50° C. The cooling medium usually consists of gases, vapors or liquids and is introduced with 30° C. to 350° C. Upon heat transfer, the cooling medium is heated to up to 450° C.

Embodiments of the process will be explained by way of example with reference to the drawing.

The heat exchanger (1) consists of a cylindrical steel jacket (13) with hemispherical head pieces (21, 15). Hot medium (2) flows through an inlet port (4) into a distribution chamber (5) and flows through spigots (22) through a plurality of tubes (6), which are disposed parallel to the longitudinal axis of the heat exchanger (1), into a second distribution chamber (7) and is discharged there through the outlet port (8). In the drawing, only four tubes (6) are represented for clarity.

Cooling medium (3) is introduced into the heat exchanger (1) through lateral ports (9). The cooling medium (3) is introduced into an inlet region (10) which is adjoined by the inner chamber (11) of the heat exchanger (1). The inner chamber (11) is substantially smaller in diameter than the inlet region (10), as it is surrounded by an outer chamber (12), which to the outside is defined by the steel jacket (13) of the heat exchanger and to the inside is separated from the inner chamber (11) by a wall (14). This wall (14) is provided with an insulation. After the distribution chamber (5), the tubes (6) first extend through the inlet region (10), then through the outer chamber (12), and end in the second distribution chamber (7).

The cooling medium (3) flows through the inner chamber (11) and impinges on a sealing plate (16), which separates the cooling medium (3) from the medium (2) to be cooled in the distribution chamber (7). At this sealing plate (16), the cooling medium (3) is deflected in direction and guided into the outer chamber (12) of the heat exchanger (1). In the outer chamber (12), sheets (17) effect a deflection of the cooling medium (3). Here, the cooling medium (3) countercurrently flows around the tubes (6) of the hot medium. The cooling medium (3) is guided in its flow direction by sheets (17) such that it alternately flows against the cylindrical steel jacket (13) and the dividing wall (14) of the inner chamber (11). The cooling medium leaves the heat exchanger (1) through the port (18).

In addition to deflecting the flow, the sheets (17) provide an increased stability and guidance of the tubes (6).

The cooling medium (3) flows from the inlet region (10) to the inner chamber (11) in the same direction as the introduced hot medium (2), which in this region flows through the tubes (6). Upon deflection of the cooling medium by the sealing plate (16) into the outer chamber (12) of the heat exchanger (1), the cooling medium (3) flows against the flow direction of the hot medium (2). To compensate the thermal expansion, a compensator (19) is mounted at the outlet port (8). The expansion of the steel jacket (13) can thus be compensated. The internal fittings are configured in a floating design.

The heat exchanger is fabricated of creep-resistant steel. In dependence on the media, a corrosion-resistant material can also be used. The insulation of the wall (14) consists of ceramics or mineral fibers which are surrounded by a protective covering. The hemispherical head pieces (21, 15) of the heat exchanger (1) are insulated with ramming mass.

The invention claimed is:

1. A heat exchanger comprising a cylindrical steel jacket and two hemispherical head pieces, with a first distribution chamber, which is connected with a second distribution chamber by means of tubes for the passage of a hot medium, at least some of the tubes extending both through an inlet region of a cooling medium and through an outer chamber, wherein lateral ports introduce the cooling medium into an inlet region which is adjoined by an inner chamber defined by a sealing plate for flow deflection of the cooling medium, that the sealing plate guides the cooling medium from the inner chamber into an outer chamber, the outer chamber enclosing the inner chamber, and this outer chamber is provided with at least one port for discharging the cooling medium.

2. The heat exchanger as claimed in claim 1, wherein a separation of the inner chamber from the outer chamber is effected by a heat-insulating wall.

3. The heat exchanger as claimed in claim 1, wherein in the outer chamber the flow of the cooling medium is deflected by sheets.

4. The heat exchanger as claimed in claim 1, wherein the inlet region is insulated against the first distribution chamber by a heat-insulating mass.

5. The heat exchanger as claimed in claim 4, wherein the heat-insulating mass is catalytically active.

6. The heat exchanger as claimed in claim 4, wherein in the vicinity of the heat-insulating mass spigots are mounted, which receive at least some of the tubes.

7. The heat exchanger as claimed in claim 1, wherein the heat exchanger is fabricated in a floating head design.

8. The heat exchanger as claimed in claim 1, wherein an outlet port of the heat exchanger has a compensator.

9. A heat exchanger comprising a cylindrical steel jacket between two hemispherical head pieces, a first of said two hemispherical head pieces comprising a first distribution chamber and a second of said two hemispherical head pieces comprising a second distribution chamber, wherein said first distribution chamber is connected with said second distribution chamber by means of a plurality of tubes for the passage of a hot medium, the cylindrical steel jacket comprising at least one inlet port for introducing a cooling medium into an inlet region adjoining an inner chamber that adjoins a sealing plate for flow deflection of the cooling medium, and the cylindrical steel jacket comprising at least one discharge port for discharging the cooling medium from an outer chamber, at least some of the tubes extending through both the inlet region and the outer chamber, said inner chamber being within the outer chamber, the inner chamber and outer chamber being radially separated by a wall, and the inlet region, the inner chamber and the outer chamber being hydraulically linked to one another so that the cooling medium flows from the inner region to the inner chamber to the outer chamber to the discharge port.

10. The heat exchanger as claimed in claim 9, wherein a separation of the inner chamber from the outer chamber is effected by a heat-insulating wall.

11. The heat exchanger as claimed in claim 9, wherein in the outer chamber the flow of the cooling medium is deflected by sheets.

12. The heat exchanger as claimed in claim 9, wherein the inlet region is insulated against the first distribution chamber by a heat-insulating mass.

13. The heat exchanger as claimed in claim 12, wherein the heat-insulating mass is catalytically active.

14. The heat exchanger as claimed in claim 12, wherein in the vicinity of the heat-insulating mass spigots are mounted, which receive at least some of the tubes.

15. The heat exchanger as claimed in claim 9, wherein an outlet port of the heat exchanger has a compensator.

* * * * *